United States Patent [19]

Mabie

[11] Patent Number: 4,505,959

[45] Date of Patent: Mar. 19, 1985

[54] MULTI-FACETED FRAMED PICTURE

[76] Inventor: Norman Mabie, P.O. Box 656, 10 Tremont St., Claremont, N.H. 03743

[21] Appl. No.: 455,507

[22] Filed: Jan. 4, 1983

[51] Int. Cl.[3] ..... B44F 3/00

[52] U.S. Cl. ..... 428/14; 40/160; 156/59; 156/63; 428/39; 428/542.2

[58] Field of Search ..... 428/13, 14, 39, 542.2, 428/912.2; 40/160, 564, 900; 156/59, 63

[56] References Cited

U.S. PATENT DOCUMENTS

| | | | |
|---|---|---|---|
| 1,904,850 | 4/1933 | Boyce et al. | 40/552 |
| 2,749,640 | 6/1956 | Scott | 428/43 |
| 3,057,097 | 10/1962 | Douglas | 428/14 |
| 3,057,099 | 10/1962 | Fruchter | 428/13 |
| 3,097,080 | 7/1963 | Weir | 428/47 X |
| 3,186,116 | 6/1965 | Freedman | 40/411 |
| 3,370,366 | 2/1968 | Van Zanten | 40/411 X |
| 3,553,062 | 1/1971 | Berlin | 428/79 X |
| 3,611,603 | 10/1971 | Gesner | 40/564 |
| 3,833,450 | 9/1974 | Powell | 428/38 X |
| 3,868,288 | 2/1975 | Ercolano | 428/340 X |
| 3,940,523 | 2/1976 | Lecoeur et al. | 428/38 |
| 4,405,664 | 9/1983 | Talbert | 428/14 |
| 4,452,839 | 6/1984 | Worden | 156/63 X |
| 4,469,726 | 9/1984 | Niinivuo | 428/13 |

*Primary Examiner*—Henry F. Epstein
*Attorney, Agent, or Firm*—Pearson & Pearson

[57] ABSTRACT

A framed, multi-faceted, appearing, colored picture, or design, such as of a spray of flowers is formed by a frame, having a front surface, or rim, in a single flat plane, the frame enclosing the colored picture and the picture being divided, in its entirety, into at least two, and preferably not more than about twenty, flat planar surfaces, each angularly disposed to the other and angularly disposed to the plane of the rim. Adjacent such surfaces meet along angular elongated ridges and angular elongated valleys to provide a desired multi-faceted appearance to the colored flower, or other, picture. The angularly disposed, flat planar surfaces are each of different outline and different area to avoid uniformity.

6 Claims, 3 Drawing Figures

MULTI-FACETED FRAMED PICTURE

BACKGROUND OF THE INVENTION

Three dimensional signs, displays, plaques and pictures have long been known, such signs and displays being exemplified in the raised letters, flowers, artificial stones, sailboats, appliques and the like disclosed in the following U.S. patents.

U.S. Pat. No. 1,904,850, Boyce, et al., Apr. 18, 1933
U.S. Pat. No. 2,749,640, Scott, June 12, 1956
U.S. Pat. No. 3,097,080, Weir, July 9, 1963
U.S. Pat. No. 3,370,366, Van Zanten, Feb. 27, 1968
U.S. Pat. No. 3,553,062, Berlin, Jan. 5, 1971
U.S. Pat. No. 3,868,288, Ercolono, Feb. 25, 1975
U.S. Pat. No. 3,940,523, Lecoeur, et al., Feb. 24, 1970.

It has also heretofore, been proposed to provide a "simulated stained glass in concrete art assembly" as in U.S. Pat. No. 3,833,450 to Powell of Sept. 3, 1974. In the assembly of the Powell Patent the design is embossed in plastic to form a plurality of projections of generally U-shaped cross section, each with side walls tapered at a slight angle and each with a flat top or front face, parallel to the background surface. The picture is formed by the cumulative effect of the flat front faces of the projections while the background is in a single plane parallel to the single plane of the rim of the frame, and to the single plane of the flat front faces of the projections.

There is also a school, or period, of cubical art wherein articles are shaped with an exterior of angularly related planar surfaces, display devices wherein such a set of articles are set in motion to attract attention of a customer being disclosed in U.S Pat. No. 3,186,116 to Feedman of June 1, 1965.

SUMMARY OF THE INVENTION

However, none of the above mentioned prior art teaches a framed, colored picture, or design, in which the picture enclosed within the frame is divided into a plurality of flat planar areas, or surfaces, each angularly disposed to the other and to the single plane of the rim and each pair of adjacent areas meeting along lines of joinder which are elongated angular ridges or elongated angular valleys.

When desired, a new multi-faceted colored picture, may be substituted in the frame, for example, a new picture or flower appropriate for a new season of the year.

DESCRIPTION OF A PREFERRED EMBODIMENT

Figure 1:
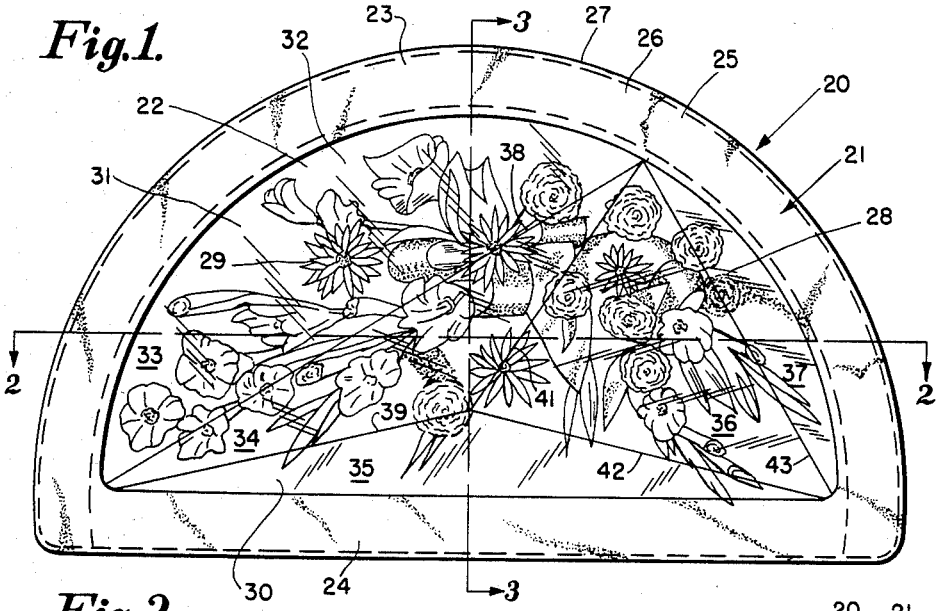
FIG. 1 is a front elevational view of a framed, multi-faceted picture of the invention.

As shown in the drawing, a framed, multi-faceted picture 20 of the invention includes the frame 21, which may be of any desired outline such as square, rectangular, oval, etc. or semi-circular as at 22, with the arcuate upper portion 23 and the straight lower portion 24 which acts as a base. Frame 21 is provided with a flat planar front rim or face, 25, which is preferably relatively wide at about two to five inches of width all around, and may be covered with fabric 26, of black, or green color, and some nap 27, if it is desired to give the visual impression of a wreath. Face 25 is normally entirely in a single flat plane, although it may be desired to have the base portion 24 of greater width and in a different plane from the arcuate portion 23 without destroying the visual effect of the framed picture 20.

Enclosed within the frame 21 is a picture, or design, 28, which preferably is a colored photograph, or painting, of a spray, swag, blanket, or wreath of natural and/or natural appearing flowers 29, in full color, the picture 28 being visible in the hollow 31 of frame 21. The visible area 32 of picture 28, exposed in the hollow 31, is divided into at least two, and preferably no more than twenty flat planar areas, or surfaces such, for example as the five areas marked 33, 34, 35, 36 and 37 in FIG. 1.

Each of the five sub areas, or subsurfaces 33, 34, 35, 36, and 37 is in a flat plane which is angularly disposed to the flat planes of the other sub areas and is angularly disposed to the flat plane of at least the arcuate, upper portion 23 of frame 21.

Figure 2:
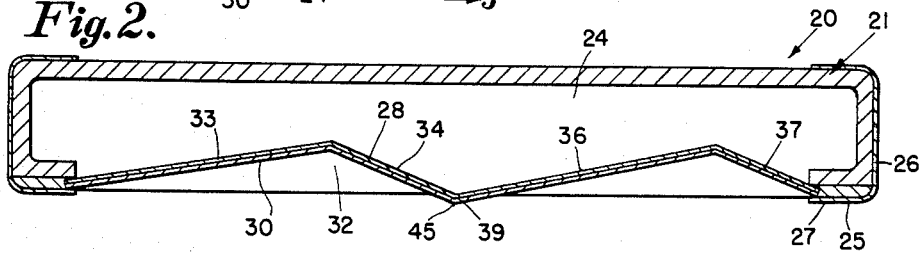
FIG. 2 is a top plan view on line 2—2 of FIG. 1.
Figure 3:
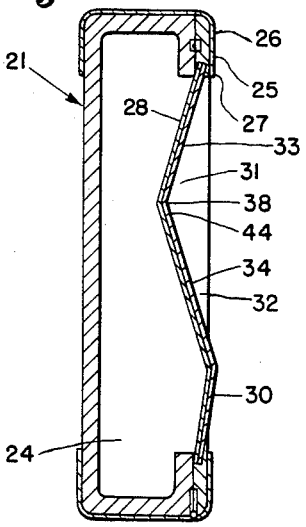
FIG. 3 is an end elevational view on line 3—3 of FIG. 1.

Each pair of adjacent sub areas such as the pair 33–34, the pair 34–35, the pair 34–36, the pair 35–36, or the pair 36–37 is interconnected along angular lines of joinder such as at 38, 39, 41, 42, or 43, which are preferably straight as shown in FIG. 1. As best shown in FIGS. 2 and 3, line of joinder 38 may be along the bottom of an angular valley 44 and line of joinder 39 may be along the top of an angular ridge 45 and some of the sub areas may be in rear of the plane of rim 25 and some may be in front of rim 25.

No sub area is in a plane common to another sub area in the same picture, and no sub area is in a flat plane which is inclined at an angle of more than about twenty degrees to the plane of the rim. While the drawing is somewhat exaggerated due to small scale illustration, a frame which is about two feet in width at the base 24, would preferably have only about the five sub areas shown in FIG. 1 and they would each be gently inclined at angles ranging from about five to ten degrees from the plane of the wide rim 25.

It will be seen that the framed picture of the invention departs from the conventional single plane surface of the prior art and, instead, creates a colored surface presentation in which two or more geometric surfaces are connected together. These plural plane surfaces may be inverted, raised or a combination of both with respect to the plane of a fixed surrounding frame. This gives the viewer a minimum of at least two view points to the picture and up to as many as desired.

As shown in the drawing, the angularly disposed, flat, planar sub-areas are each of different peripheral outline and different area to avoid uniformity.

Unlike Picasso, who sought most successfully to depict form in a single plane on canvas by a series of painted rectangles, in this invention the presentation is three dimensional with floral, or other paintings being presented in multi-planar, or multi-faceted, form and not in single planar form.

The picture 28 may be covered by a plastic layer or by suitably shaped glass sections indicated at 30, in FIGS. 1–3.

It should be noted that the pictures 28 and 48 are multi-faceted and three dimensional in their entirety with flat, planar sub areas, elongated angular ridges and elongated angular valleys while free of curved surfaces or flat areas in planes parallel to the plane of the rim.

I claim:

1. In combination:

a frame having a front rim in a single flat plane;

a picture, or design, enclosed within said frame;

said picture being divided in its entirety into at least two, and no more than about twenty, interconnected, flat, planar sub areas, angularly disposed to each other and to said flat planar front rim, adjacent said sub areas meeting along elongated angular ridges and elongated angular valleys;

said picture presenting a multi-faceted appearance being free of rounded surfaces and each sub area being of different peripheral outline and area from the other sub areas.

2. A framed picture comprising:

a frame having a front rim in substantially a single flat plane;

a picture enclosed within, and supported by, said frame and having a visible area divided in its entirety into at least four interconnected flat plane sub areas, angularly disposed to each other and angularly disposed to the plane of said rim at a slight incline of not more than about twenty degrees each sub area being of different peripheral outline and area from the other sub areas and said picture thereby presenting a multi-faceted appearance.

3. A framed picture as specified in claim 2 wherein:

said visible area of said picture is divided in its entirety into at least four and no more than about twenty said interconnected, flat plane sub areas, no said sub area being in a plane common to another said sub area.

4. A framed picture as specified in claim 2 wherein:

some of said flat plane sub areas are in the rear of the plane of said rim and some of said flat plane sub areas are in front of the plane of said rim.

5. A framed picture comprising:

a frame having a front planar rim; and a colored picture mounted within said frame and having a multi-faceted appearance formed by a division thereof into a plurality of flat planar interconnected sub areas, each angularly disposed to the other in a different plane and each joined to adjacent sub areas along elongated angular lines of joinder to present in its entirety a multi-faceted appearance formed by angular ridges and angular valleys free of curved surfaces each sub area being of different peripheral outline and of different area than the other sub areas.

6. In combination:

a picture frame having a front rim, in a single flat plane and enclosing a hollow;

a colored picture enclosed within the rim of said frame and occupying said hollow;

said picture being divided into at least two, and no more than about twenty, interconnected sub areas, each sub area in a flat plane different from the flat plane of the adjacent sub areas and angularly disposed to the flat plane of the adjacent sub areas and to said common flat plane of said rim, each sub area being of different peripheral outline and area from the other sub areas;

said sub areas meeting along elongated angular ridges and elongated angular valleys and giving said picture an over-all multi-faceted, three dimensional, appearance free of curved surfaces;

the angles of said flat plane sub areas to adjacent sub areas, and to said rim, ranging generally between about five to not more than about twenty degress.

* * * * *